US010335916B2

(12) United States Patent
Graham

(10) Patent No.: US 10,335,916 B2
(45) Date of Patent: Jul. 2, 2019

(54) METHOD FOR FORMING A WORKPIECE

(71) Applicants: SAINT-GOBAIN ABRASIVES, INC., Worcester, MA (US); SAINT-GOBAIN ABRASIFS, Conflans-Sainte-Honorine (FR)

(72) Inventor: David C. Graham, Oakham, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 0 days.

(21) Appl. No.: 14/324,862

(22) Filed: Jul. 7, 2014

(65) Prior Publication Data

US 2015/0017885 A1 Jan. 15, 2015

Related U.S. Application Data

(60) Provisional application No. 61/843,865, filed on Jul. 8, 2013.

(51) Int. Cl.

| | |
|---|---|
| ***B24B 27/00*** | (2006.01) |
| ***B24D 3/14*** | (2006.01) |
| ***B24B 7/22*** | (2006.01) |
| ***B24B 19/00*** | (2006.01) |

(52) U.S. Cl.

CPC ..... *B24B 7/22* (2013.01); *B24B 19/009* (2013.01)

(58) Field of Classification Search

CPC ..... B24B 19/009; B24B 7/22

See application file for complete search history.

(56) References Cited

U.S. PATENT DOCUMENTS

| | | | | |
|---|---|---|---|---|
| 5,533,931 | A * | 7/1996 | Imai | B24B 1/00 451/11 |
| 6,632,123 | B1 * | 10/2003 | Nienhaus | B24B 3/02 451/48 |
| 6,669,118 | B2 | 12/2003 | Webster | |
| 7,147,547 | B2 * | 12/2006 | Junker | B24B 5/14 451/132 |
| 8,062,097 | B2 * | 11/2011 | Clewes | B24B 19/06 451/49 |

(Continued)

FOREIGN PATENT DOCUMENTS

| | | | |
|---|---|---|---|
| DE | 102011108357 | A1 | 1/2013 |
| EP | 1700670 | A2 | 9/2006 |

(Continued)

OTHER PUBLICATIONS

Search Report from PCT/US2014/045588 dated Oct. 28, 2014, 1 page.

*Primary Examiner* — Marc Carlson

(74) *Attorney, Agent, or Firm* — Abelschillinger, LLP; Alexander H Plache

(57) ABSTRACT

A method of forming a workpiece having machinability rating not greater than a machinability rating of Inconel 718. The method may include removing material from the workpiece by moving at least one grinding tool relative to the workpiece and may be conducted at a specific grinding energy of not greater than about 7 Hp/in$^3$ min (about 19 J/mm$^3$) for a material removal rate of at least about 2.5 in$^3$/min·in (about 25 mm$^3$sec/mm).

15 Claims, 13 Drawing Sheets

(56) References Cited

U.S. PATENT DOCUMENTS

| | | | | |
|---|---|---|---|---|
| 2003/0097800 | A1* | 5/2003 | Ramanath | B24D 3/10 51/309 |
| 2007/0275641 | A1* | 11/2007 | Subramanian | B24B 1/00 451/57 |
| 2009/0093198 | A1 | 4/2009 | Subramanian et al. | |
| 2010/0178169 | A1* | 7/2010 | Webb | F01D 5/087 416/95 |
| 2010/0251625 | A1* | 10/2010 | Gaeta | B24D 3/00 51/298 |
| 2011/0179646 | A1* | 7/2011 | Barnat | B24B 19/009 29/889.21 |
| 2012/0034847 | A1* | 2/2012 | Besse | B24B 1/00 451/28 |
| 2013/0074418 | A1* | 3/2013 | Panzarella | B24D 3/348 51/295 |

FOREIGN PATENT DOCUMENTS

| | | | |
|---|---|---|---|
| WO | 2007/079646 | A1 | 7/2007 |
| WO | 2011083082 | A1 | 7/2011 |

* cited by examiner

METHOD FOR FORMING A WORKPIECE

CROSS-REFERENCE TO RELATED APPLICATION

The present application claims priority from U.S. Provisional Patent Application No. 61/843,865, filed Jul. 8, 2013, entitled "METHOD FOR FORMING A WORKPIECE," naming inventor David C. Graham, and said provisional application is incorporated by reference herein in its entirety for all purposes.

BACKGROUND

Field of the Disclosure

The following is directed to methods of forming workpieces using abrasive tools, and more particularly, use of grinding tools for grinding and finishing surfaces of workpieces.

Description of the Related Art

Within the grinding industry, various processes may be employed to form workpieces. However, in the particular context of forming workpieces having a low machinability rating (i.e., difficult to machine), few options are available since operations for forming such workpieces require exacting surface contours and tight dimensional tolerances. Certain preferred approaches are milling or broaching, where blades are used to cut the shape in the workpiece, as opposed to grinding processes. However, broaching can be an expensive operation, due to high tooling costs, expensive machinery, set-up costs, tooling regrinding costs and slow material removal rates. Milling processes are generally very slow, especially in machining difficult-to-machine materials, such as nickel alloys.

Accordingly, there is a need to develop new methods to form surfaces of workpieces.

SUMMARY

According to a first aspect, a method of forming a workpiece may include removing material from a workpiece having a machinability rating not greater than the machinability rating of Inconel 718. Removing material may include moving at least one grinding tool relative to the workpiece. During moving, the at least one grinding tool may be oriented at an angle ($\alpha$) relative to a reference plane of the workpiece. Removing material may further be conducted at a specific grinding energy of not greater than about 7 Hp/in$^3$ min (about 19 J/mm$^3$) for a material removal rate of at least about 2.5 in$^3$/min·in (about 25 mm$^3$sec/mm).

According to another aspect, a method of forming a workpiece may include removing material from a workpiece having a machinability rating not greater than the machinability rating of Inconel 718 at a specific grinding energy of not greater than about 7 Hp/in$^3$ min (about 19 J/mm$^3$) for a material removal rate of at least about 2.5 in$^3$/min·in (about 25 mm$^3$sec/mm). Removing material may include moving a first grinding tool having a first peripheral contour relative to the workpiece and moving a second grinding tool having a second peripheral contour different than the first peripheral contour relative to the workpiece.

According to yet another aspect, a method of grinding a workpiece having machinability rating not greater than the machinability rating of Inconel 718 and at least one complex surface feature. The method may define a grinding process capable of removing at least about 3.5 in$^3$ of material per min (in$^3$/min).

According to still another aspect, a method of forming a workpiece may include removing material from a workpiece having a machinability rating not greater than the machinability rating of Inconel 718 and at least one complex feature. Removing material may include moving at least one grinding tool relative to the workpiece. The grinding tool may include an abrasive wheel comprising a grinding surface defining the outer perimeter of the grinding wheel. The grinding surface may include a contour that may be configured to form at least a portion of the complex surface feature of the workpiece.

According to yet another aspect, a method of forming an internal surface on a workpiece may include removing material from a rotating workpiece having a machinability rating not greater than the machinability rating of Inconel 718, wherein removing material may include moving at least one grinding tool relative to the rotating workpiece. The diameter of the grinding tool may be not greater than about twice the length of a hypotenuse of a right triangle having a first side length equal to the distance along an axis of rotation of the workpiece between the workpiece and the grinding tool and a second side length equal to a distance between a center-point of the workpiece and a point of the outer perimeter of a feature of the workpiece having the smallest diameter and being normal to the surface of the workpiece.

According to still another aspect, a method of forming a workpiece may include removing material from a workpiece having machinability rating not greater than Inconel 718. Removing material may include moving a grinding tool relative to the workpiece. The grinding tool may be oriented at an angle ($\alpha$) relative to a reference plane of the workpiece. During removal of the material, not greater than about 5% of the surface of the workpiece may experience burn.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

Figure 1:
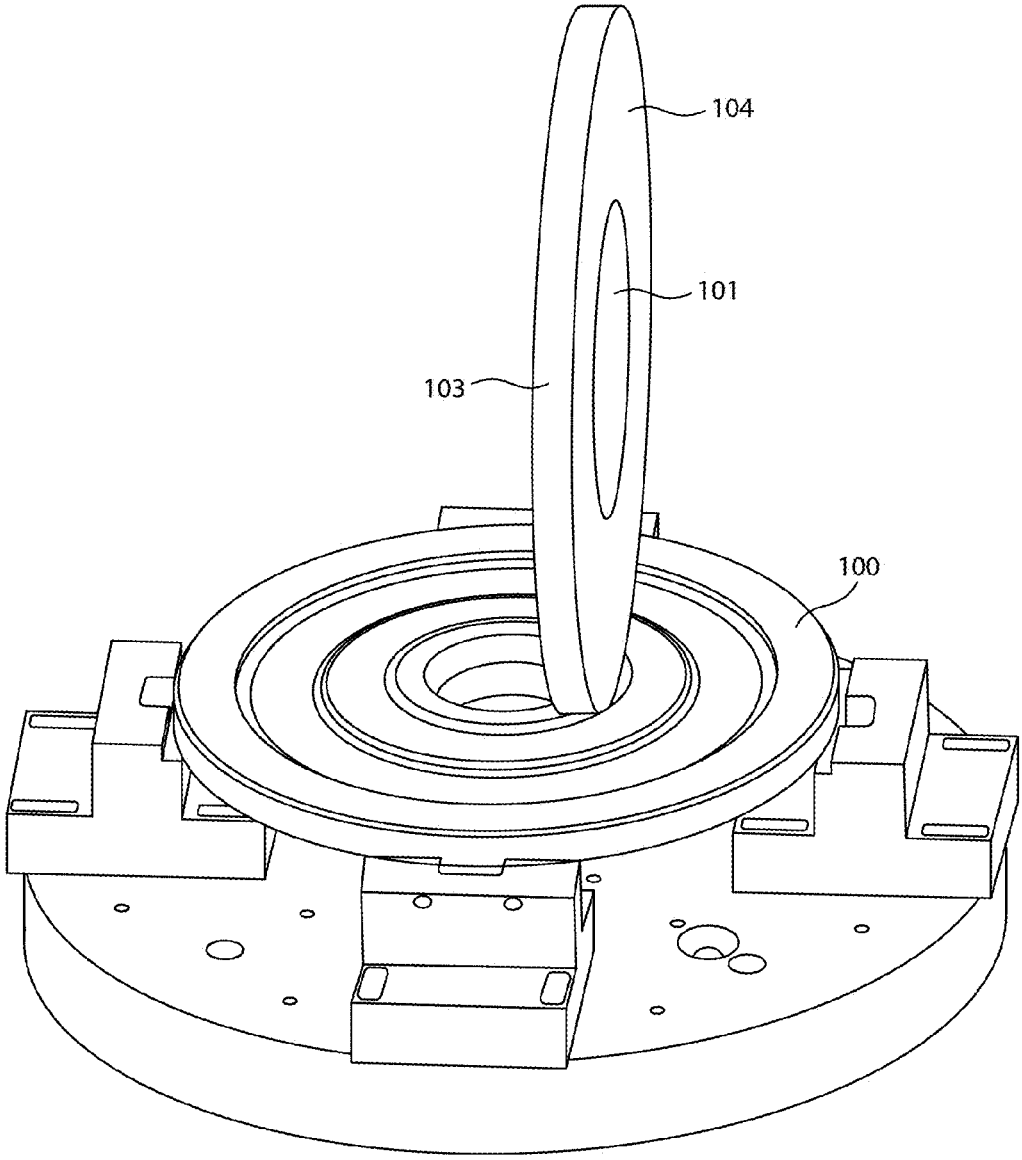
FIG. 1 includes a schematic representation of a grinding method in accordance with an embodiment.

The following is directed to methods of forming a workpiece, including using grinding tools to grind and finish complex surface features on a workpiece. In at least one embodiment, the method may include using bonded abrasive grinding tools suitable for forming and/or finishing of surfaces of a workpiece. It will be appreciated that bonded abrasives are a separate and distinct class from other abrasives (e.g. coated abrasives, etc.) in that bonded abrasives have a three-dimensional shape including a dispersion of abrasive particles throughout out a three-dimensional volume, which are contained within a three-dimensional volume of bonding material. Moreover, bonded abrasive bodies may include some amount of porosity, which may facilitate chip formation and exposure of new abrasive particles. Chip formation, abrasive grain exposure, and dressing are certain attributes associated with bonded abrasives, and which distinguish bonded abrasives from other classes of abrasives, such as coated abrasives or single layer electroplated tools.

As used herein, the term "complex feature" refers to a shape (e.g., of a surface of a workpiece) or a shape of a part (e.g., a grinding surface of a grinding tool) that can have a contour defining a concave curvature, a convex curvature, a non-linear pathway, a pathway defining at least three distinct portions angled with respect to each other or a combination thereof. As further used herein, the term "complex shape" refers to at least one complex feature on a surface of a workpiece and may further refer to a combination of multiple complex features on a surface of a workpiece.

The grinding methods described herein may be utilized in a variety of industries, including for example, construction, mining, aeronautics, navel architecture and construction, advanced machining applications, and the like.

The grinding methods described herein including the grinding and finishing of complex shapes on workpiece surfaces may be completed on certain types of workpiece materials including hard-to-grind materials. According to one particular embodiment, the workpiece may be a cast metal. According to yet another embodiment, the workpiece may be a powdered metal. The workpieces of the embodiments herein can be metallic, and particularly metal alloys such as titanium, Inconel (e.g., IN-718), nickel alloys, steel-chrome-nickel alloys (e.g., 100 Cr6), carbon steel (AISI 4340 and AISI 1018) and combinations thereof. According to still other embodiments the workpiece may include at least about 50 wt % nickel alloy for the total weight of the workpiece, such as, at least about 60 wt % nickel alloy, at least about 70 wt % nickel alloy, at least about 80 wt % nickel alloy, at least about 90 wt % nickel alloy or even at least about 95 wt % nickel alloy for the total weight of the workpiece. In still other embodiments the workpiece may include not greater than about 100 wt % nickel alloy for the total weight of the workpiece, such as, not greater than about 95 wt % nickel alloy, not greater than about 80 wt % nickel alloy, not greater than about 70 wt % nickel alloy or even not greater than about 60 wt % nickel alloy for the total weight of the workpiece. It will be appreciated that the workpiece may include any weight percent of nickel alloy within a range between any of the minimum and maximum values noted above.

In accordance with one embodiment, the workpiece can have a particular Rockwell C hardness (Rc) value. For example, the workpiece may have a hardness value of not greater than about 65 Rc, such as, not greater than about 60 Rc, not greater than about 55 Rc, not greater than about 50 Rc, not greater than about 45 Rc, not greater than about 40 Rc, not greater than about 35 Rc, not greater than about 30 Rc, not greater than about 25 Rc, not greater than about 20 Rc, not greater than about 20 Rc, not greater than about 15, not greater than about 10 Rc or even not greater than about 5 Rc. According to other non-limiting embodiments, the workpiece can have a hardness value of at least about 4 Rc, such as, at least about 5 Rc, at least about 10 Rc, at least about 15 Rc, at least about 20 Rc, at least about 25 Rc, at least about 30 Rc, at least about 35 Rc, at least about 40 Rc, at least about 45 Rc, at least about 50 Rc, at least about 55 Rc, at least about 60 Rc or even at least about 64 Rc. It will be appreciated that the workpiece may have a hardness value within a range between any of the minimum and maximum values noted above.

In particular embodiments, the grinding method may be used to remove material from a workpiece having a particular machinability rating. A machinability rating may be expressed as a percentage of a normalized value. In general, the material 160 Brinell B1112 steel is assigned a machinability rating of 100% (i.e., 1). It will be appreciated that a machinability rating less than 100% (i.e. less than 1) would be more difficult to machine than 60 Brinell B1112 steel and a machinability rating greater than about 100% (greater than 1) would be easier to machine than 60 Brinell B1112 steel. According to certain embodiments, the grinding method may be used to remove material from a workpiece having a machinability rating of not greater than about 0.3, such as, not greater than about 0.25, not greater than about 0.2, not greater than about 0.18, not greater than about 0.16, not greater than about 0.14, not greater than about 0.12, not greater than about 0.1, not greater than about 0.08, not greater than about 0.06 or even not greater than 0.04. According to other embodiments, the grinding method may be used to remove material from a workpiece having a machinability rating of at least about 0.03, such as, at least about 0.04, at least about 0.06, at least about 0.8, at least about 0.1, at least about 0.12, at least at least about 0.16, at least about 0.18, at least about 0.2, at least about 0.25 or even at least about 0.29. It will be appreciated that the grinding method may be used to remove material from a workpiece having a machinability rating of any value within a range between any of the minimum and maximum values noted above.

According to certain embodiments, the grinding method may be used to remove material from a workpiece have a machinability rating less than the machinability rating of Inconel 718 (i.e., the workpiece is more difficult to machine the Inconel 718). Inconel 718 is a nickel-chromium-based superalloy having a machinability rating of between about 0.12 and about 0.16 (relative to 160 Brinell B112 steel). It should also be appreciated that a machinability rating may also be expressed as a relative percent of the machinability of another material, for example, as a relative percent of the machinability of Inconel 718. According to certain embodiments, the grinding method may be used to remove material from a workpiece having a machinability rating of not greater than about 90% of the machinability rating of Inconel 718, such as, not greater than about 80% of the machinability rating of Inconel 718, not greater than about 70% of the machinability rating of Inconel 718, not greater than about 60% of the machinability rating of Inconel 718, not greater than about 50% of the machinability rating of Inconel 718, not greater than about 40% of the machinability rating of Inconel 718, not greater than about 30% of the machinability rating of Inconel 718, not greater than about 20% of the machinability rating of Inconel 718, not greater than about 10% of the machinability rating of Inconel 718 or even not greater than about 5% of the machinability rating of Inconel 718. According to still other non-limiting embodiments, the workpiece may have a machinability rating of at least about 2% of the machinability rating of Inconel 718, such as, at least about 5% of the machinability rating of Inconel 718, at least about 10% o of the machinability rating of Inconel 718, at least about 50% of the machinability rating of Inconel 718, at least about 20% of the machinability rating of Inconel 718, at least about 30% of the machinability rating of Inconel 718, at least about 40% of the machinability rating of Inconel 718, at least about 50% of the machinability rating of Inconel 718, at least about 60% of the machinability rating of Inconel 718, at least about 70% of the machinability rating of Inconel 718, at least about 90% of the machinability rating of Inconel 718 or even at least about 95% of the machinability rating of Inconel 718. It will be appreciated that a workpiece may have any percentage of the machinability rating of Inconel 718 within a range between any of the minimum and maximum values noted above.

According to still other embodiments, the grinding method may utilize a particular specific grinding energy. For example, the specific grinding energy may be not greater than about 7 Hp/in$^3$ min (about 19 J/mm$^3$), such as, not greater than about 6 Hp/in$^3$ min, not greater than about 5 Hp/in$^3$ min, not greater than about 4 Hp/in$^3$ min, not greater than about 3 Hp/in$^3$ min, not greater than about 2 Hp/in$^3$ min or even not greater than about 1 Hp/in$^3$ min. According to yet other embodiments, the specific grinding energy may be at least about 0.5 Hp/in$^3$ min (about 1.4 J/mm$^3$), such as, at least about 1 Hp/in$^3$ min, at least about 2 Hp/in$^3$ min, at least about 3 Hp/in$^3$ min, at least about 4 Hp/in$^3$ min, at least about 5 Hp/in$^3$ min or even at least about 6 Hp/in$^3$ min. It will be appreciated that the specific grinding energy may be any value within a range between any of the minimum and maximum values noted above.

It will be appreciated that the specific grinding energies noted above may be achieved at certain material removal rates. For example, the specific grinding energies noted above may be achieved at a material removal rate of at least about 0.01 inches$^3$/min/inch [0.11 mm$^3$/sec/mm]. In other instances, the material removal process can be conducted at a material removal rate of at least about 0.05 inches$^3$/min/inch [0.54 mm$^3$/sec/mm], such as, at least about 0.08 inches$^3$/min/inch [0.86 mm$^3$/sec/mm], at least about 0.1 inches$^3$/min/inch [1.1 mm$^3$/sec/mm], at least about 0.3 inches$^3$/min/inch [3.2 mm$^3$/sec/mm], at least about 1 inch$^3$/min/inch [11 mm$^3$/sec/mm], at least about 1.5 inches$^3$/min/inch [16 mm$^3$/sec/mm], at least about 2 inches$^3$/min/inch [22 mm$^3$/sec/mm], at least about 2.5 inches$^3$/min/inch [27.5 mm$^3$/sec/mm], at least about 3.0 inches$^3$/min/inch [33 mm$^3$/sec/mm] or even at least about 3.5 inches$^3$/min/inch [35 mm$^3$/sec/mm]. For certain operations, the specific grinding energies noted above may be achieved at a material removal rate of not greater than about 4 inches$^3$/min/inch [44 mm$^3$/sec/mm]. Still, certain material removal processes may have a material removal rate of not greater than about 3.5 inch$^3$/min/inch [38.5 mm$^3$/sec/mm], not greater than about 2.5 inches$^3$/min/inch [8.6 mm$^3$/sec/mm], or even not greater than about 1.5 inches$^3$/min/inch [16 mm$^3$/sec/mm]. It will be appreciated that the material removal rate may be any value within a range between any of the minimum and maximum values noted above.

Referring now to operations for grinding described herein, a process of moving a grinding tool relative to a surface of the workpiece may be undertaken to form at least a portion of the complex shape of the surface of the workpiece. In particular instances, the process of moving the grinding tool can include and be referred to herein as a grinding process, a material removal process, a finishing process, and a combination thereof. More particularly, the process of moving the grinding tool relative to the workpiece can be conducted to change the contour of the surface to a complex shape (e.g., a shape including at least one complex feature). The grinding tools used to conduct the grinding and/or finishing process can be part of high efficiency grinding machines, including multi-axis machining centers.

FIG. 1 includes an illustration of a process of moving a grinding tool relative to a portion of a workpiece in accordance with an embodiment. In particular, FIG. 1 illustrates a grinding or finishing operation to form a complex shape on a surface of a workpiece 100 with a grinding tool 101. The grinding tool 101 may be a grinding wheel having a peripheral grinding surface 103 defining the perimeter of the grinding tool 101. In certain embodiments, the peripheral grinding surface 103 may be a flat surface parallel to an axis of rotation of the tool as shown in FIG. 1. In still other embodiments, the peripheral grinding surface 103 may have a contour of a complex shape suitable for producing a complex shape on the surface of the workpiece 100. That is, the grinding surface 103 may have a contour that is the inverse of a complex shape (i.e., at least one complex feature) to be imparted onto the surface of the workpiece 100.

In accordance with embodiments herein, the grinding tool 101 can have a bonded abrasive body 104 including abrasive particles contained within a matrix of bonding material. That is, the bonded abrasive body 104 can have abrasive particles dispersed throughout a three-dimensional matrix of bonding material.

In accordance with an embodiment, the abrasive particles can include superabrasive materials. For example, suitable superabrasive materials can include cubic boron nitride, diamond, and a combination thereof. In certain instances, the bonded abrasive body 104 can include abrasive particles that consist essentially of diamond. However, in other tools, the bonded abrasive body 104 can include abrasive particles that consist essentially of cubic boron nitride. The abrasive particles may also include sintered sol gel alumina ceramic grains (e.g., Norton® TG2 or TGX Abrasives), as a filamentary abrasive grain.

The bonded abrasive tool can be formed such that it has an abrasive body incorporating abrasive particles having an average particle size of not greater than about 150 microns. In some embodiments, the abrasive particles can have an average particle size of not greater than about 125 microns, such as not greater than about 100 microns, or even not greater than about 95 microns. In one non-limiting embodiment, the abrasive particles can have an average particle size of at least about 1 micron, such as at least about 10 microns, at least about 15 microns, at least about 20 microns, or even at least about 30 microns. It will be appreciated that the abrasive particles can have an average particle size within a range between any of the minimum and maximum values noted above.

With regard to the bonding material within the bonded abrasive body 104, suitable materials can include organic materials, inorganic materials, and a combination thereof. For example, suitable organic materials may include polymers such as resins, epoxies, and the like.

Some suitable inorganic bond materials can include metals, metal alloys, ceramic materials, glass materials, and a combination thereof. For example, some suitable metals can include transition metal elements and metal alloys containing transition metal elements. In other embodiments, the bond material may be a ceramic material, which can include polycrystalline and/or vitreous materials. Suitable ceramic bonding materials can include oxides, including for example, $SiO_2$, $Al_2O_3$, $B_2O_3$, MgO, CaO, $Li_2O$, $K_2O$, $Na_2O$ and the like.

Further, it will be appreciated that the bonding material can be a hybrid material. For example, the bonding material can include a combination of organic and inorganic components. Some suitable hybrid bond materials can include metal and organic bond materials.

In accordance with at least one embodiment, the bonded abrasive body 104 can include a composite including bond material, abrasive particles, and some porosity. For example, the bonded abrasive body 104 can have at least about 2 vol % abrasive particles (e.g., superabrasive particles) for a total volume of the bonded abrasive body. In other instances, the bonded abrasive body 104 can include at least about 6 vol %, at least about 10 vol %, at least about 15 vol %, at least about 20 vol %, at least about 25 vol %, at least about 30 vol %, at least about 35 vol %, at least about 40 vol %, at least about 45 vol % or even at least about 50 vol % abrasive particles. In one non-limiting embodiment, the bonded abrasive body 104 can include not greater than about 65 vol %, such as not greater than about 60 vol %, or even not greater than about 55 vol % superabrasive particles. It will be appreciated that the content of abrasive particles in the bonded abrasive body 104 can be within a range between any of the minimum and maximum values noted above.

According to yet another embodiment, the abrasive particles in the bonded abrasive body 104 can be agglomerated particles. According to still other embodiments, the agglomerated particles can include a binder and abrasive grains within the binder. According to yet another embodiment, the abrasive grains may be ceramic abrasive grains. According to still another embodiment, the agglomerate may include a particular content of ceramic grains in volume percent for a total volume of the agglomerate. For example, the agglomerate may include at least about 10 vol % ceramic grains for a total volume of the agglomerate, such as, at least about 15 vol %, at least about 20 vol %, at least about 25 vol %, at least about 30 vol %, at least about 35 vol %, at least about 40 vol % or even at least about 50 vol %. According to still other embodiments, the agglomerate may include not greater than about 90% ceramic grains for a total volume of the agglomerate, such as, not greater than about 80 vol %, not greater than about 70 vol %, not greater than about 60 vol %, not greater than about 55 vol % or even not greater than about 50 vol %. It will be appreciated that the content of ceramic grains in the agglomerate can be within a range between any of the minimum and maximum values noted above.

According to yet another embodiment, the agglomerates may include a particular content of binder in volume percent for a total volume of the agglomerate. For example, the agglomerate may include at least about 10 vol % binder for a total volume of the agglomerate, such as, at least about 15 vol %, at least about 20 vol %, at least about 25 vol %, at least about 30 vol %, at least about 35 vol %, at least about 40 vol %, at least about 50 vol %. According to still other embodiments, the agglomerate may include not greater than about 90% binder for a total volume of the agglomerate, such as, not greater than about 80 vol %, not greater than about 70 vol %, not greater than about 60 vol %, not greater than about 55 vol % or even not greater than about 50 vol %. It will be appreciated that the content of binder in the agglomerate can be within a range between any of the minimum and maximum values noted above.

According to yet another embodiment, the agglomerates may include a particular porosity in volume percent for a total volume of the agglomerate. For example, the agglomerate may include at least about 1 vol % porosity for a total volume of the agglomerate, such as, at least about 5 vol %, at least about 10 vol %, at least about 15 vol %, at least about 20 vol %, at least about 25 vol %, at least about 30 vol %, or even at least about 40 vol %. According to still other embodiments, the agglomerate may include not greater than about 60 vol % porosity for a total volume of the agglomerate, such as, not greater than about 50 vol %, not greater than about 40 vol %, not greater than about 30 vol %, not greater than about 20 vol % or even not greater than about 10 vol %. It will be appreciated that the porosity in the agglomerate can be within a range between any of the minimum and maximum values noted above.

The bonded abrasive body 104 can be formed to have at least about 2 vol % bond material (e.g., vitrified bond or metal bond material) for a total volume of the bonded abrasive body 303. In other instances, the bonded abrasive body 104 can include at least about 4 vol %, at least about 6 vol %, at least about 8 vol %, at least about 10 vol %, or even at least about 15 vol %. In one non-limiting embodiment, the bonded abrasive body 104 can include not greater than about 65 vol %, such as not greater than about 60 vol %, not greater than about 55 vol %, not greater than about 50 vol %, not greater than about 45 vol %, not greater than about 40 vol %, not greater than about 35 vol %, not greater than about 30 vol %, not greater than about 25 vol %, or even not greater than about 20 vol %. It will be appreciated that the content of bond material in the bonded abrasive body 104 can be within a range between any of the minimum and maximum values noted above.

The bonded abrasive body 104 can be formed to have a certain content of porosity, and particularly, an amount of not greater than about 60 vol % for a total volume of the bonded abrasive body 104. For example, the bonded abrasive body 303 can have not greater than about 55 vol % porosity, such as not greater than about 50 vol %, not greater than about 45 vol %, not greater than about 40 vol %, not greater than about 35 vol %, or even not greater than about 30 vol % porosity. In one non-limiting embodiment, the bonded abrasive body 104 can include at least about 0.5 vol %, at least about 1 vol %, at least about 1.5 vol %, at least about 2 vol %, at least about 5 vol %, at least about 10 vol %, at least about 15 vol %, at least about 20 vol %, at least about 25 vol %, at least about 30 vol %, at least about 35 vol %, at least about 40 vol % or even at least about 45 vol %. It will be appreciated that the content of porosity in the bonded abrasive body 104 can be within a range between any of the minimum and maximum values noted above.

The bonded abrasive body may include particular types of porosity. For example, the porosity may be a permeable or interconnected porosity. Permeable or interconnected porosity may be formed as natural porosity, leached porosity or foamed porosity. Natural porosity arises from packing of the abrasive grains and bond particles during formation of the abrasive article. Leached porosity arises from the evaporation or burn off of a particular during formation of the abrasive article. Foamed porosity arises from chemical interaction of the components that releases gas during formations of the abrasive article. According to other embodiments, the porosity may be a closed porosity. Closed porosity is often formed using pore inducers (e.g., hollow ceramic or glass spheres).

According to yet another embodiment, the porosity of the bonded abrasive body may include a particular content of interconnected porosity in volume percent for a total volume of the porosity in the bonded abrasive body. For example, the porosity may include interconnected porosity of not greater than about 90 vol % for a total volume of the porosity in the bonded abrasive body, such as, not greater than about 80 vol %, not greater than about 70 vol %, not greater than about 60 vol %, not greater than about 50 vol %, not greater than about 40 vol %, not greater than about 30 vol %, not greater than about 20 vol % or even not greater than about 10 vol %. According to still another embodiment, the porosity may include interconnected porosity of at least about 10 vol % for a total volume of porosity of the bonded abrasive body, such as, at least about 20 vol %, at least about 30 vol %, at least about 40 vol %, at least about 50 vol %, at least about 60 vol %, at least about 70 vol %, at least about 80 vol %, at least about 90 vol %, at least about 99 vol % or even substantially all of the porosity of the body may be interconnected porosity. It will be appreciated that the content of interconnected porosity in the bonded abrasive body 104 can be within a range between any of the minimum and maximum values noted above.

In accordance with one embodiment, the grinding process may remove a particular amount of material from the surface of the workpiece 100 on each pass. A pass may be defined a consecutive period of time in which the abrasive tool 101 is in contact with the workpiece 100. The amount of material removal conducted by one pass of grinding may be represented as a particular depth of material removed from the surface of the workpiece. For example, during material removal, the grinding tool 101 may remove at least about 0.005 inches of material from the surface of the workpiece, such as, at least about 0.006 inches of material, at least about 0.007 inches of material, at least about 0.008 inches of material, at least about 0.009 inches of material, at least about 0.01 inches of material, at least about 0.05 inches of material or even at least about 0.02 inches of material from the surface of the workpiece. According to still other embodiments, the grinding tool 101 may remove not greater than about 0.03 inches of material from the surface of the workpiece, such as, not greater than about 0.02 inches of material, not greater than about 0.015 inches of material, not greater than about 0.01 inches of material or even not greater than about 0.05 inches of material. It will be appreciated that the grinding tool 101 may remove a depth of material of any value within a range between any of the minimum and maximum values noted above.

Moreover, during material removal, the feed rate of the grinding tool 101, which is a measure of the lateral movement of the bonded abrasive tool along a lateral axis of a surface of the workpiece can be at least about 30 ipm [762 mm/min]. In other embodiments, the feed rate can be greater, such as at least about 50 ipm [1270 mm/min], at least about 75 ipm [1905 mm/min], at least about 100 ipm [2540 mm/min], or even at least about 125 ipm [3175 mm/min]. Certain finishing processes utilize a feed rate within a range between about 30 ipm [762 mm/min] and about 300 ipm [7620 mm/min], such as between about 50 ipm [1270 mm/min] and about 250 ipm [6350 mm/min], or even within a range between about 50 ipm [1270 mm/min] and about 200 ipm [5080 mm/min].

Figure 2:
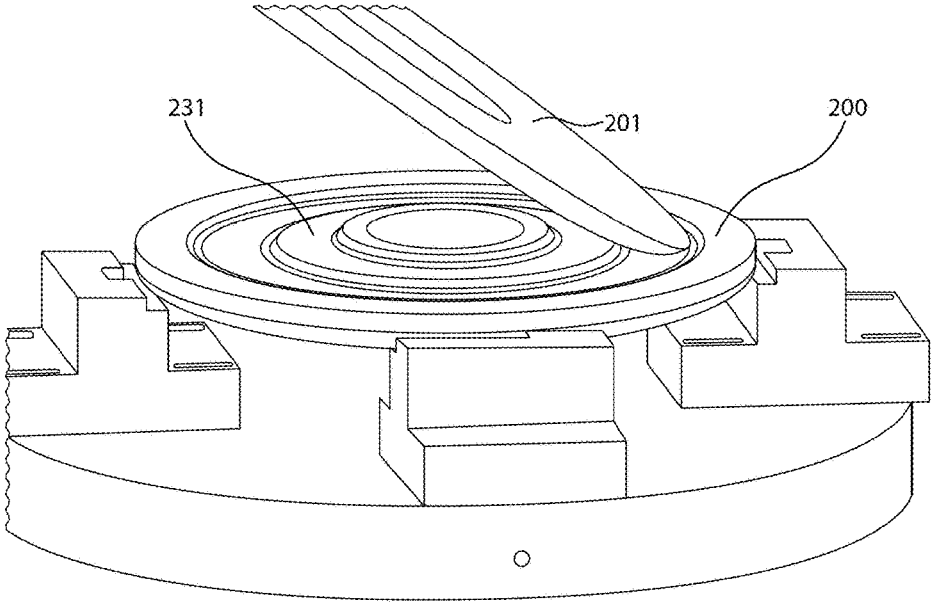
FIG. 2 includes a schematic representation of a grinding method in accordance with an embodiment.

As illustrated in FIG. 2, according to one embodiment, during moving of a grinding tool 201 to conduct a grinding process as described herein, the grinding tool 201 can be oriented at an angle relative to a lateral reference plane of a workpiece 200. The lateral plane can be generally a plane defined by a major surface 231 of the workpiece 200. In certain instances, the lateral reference plane can be a plane generally perpendicular to the thickness of the workpiece 201. According to one embodiment the grinding tool may be oriented at an angle of at least about 5 degrees relative to the lateral reference plane, such as, the least about 10 degrees, at least about 15 degrees, at least about 20 degrees, at least about 25 degrees, at least about 30 degrees, at least about 35 degrees, at least about 40 degrees, at least about 50 degrees, at least about 55 degrees, at least about 60 degrees, at least about 65 degrees, at least about 70 degrees, at least about 75 degrees, at least about 80 degrees or even at least about 89 degrees relative to the reference plane. According to still other embodiments, the grinding tool may be perpendicular (i.e., oriented at an angle 90 degrees relative) to the lateral reference plane of the workpiece. According to still other embodiments, the grinding tool may be oriented at an angle of not greater than about 90 degrees relative to the lateral reference plane, such as, not greater than about 85 degrees, not greater than about 80 degrees, not greater than about 75 degrees, not greater than about 70 degrees, not greater than about 65 degrees, not greater than about 60 degrees, not greater than about 55 degrees, not greater than about 50 degrees, not greater than about 45 degrees, not greater than about 40 degrees, not greater than about 45 degrees, not greater than about 30 degrees, not greater than about 25 degrees, not greater than about 20 degrees, not greater than about 15 degrees or even not greater than about 10 degrees. It will be appreciated that the grinding tool may be oriented at an angle relative to the lateral reference plane of the workpiece of any value within a range between any of the minimum that values noted above.

Figure 3:
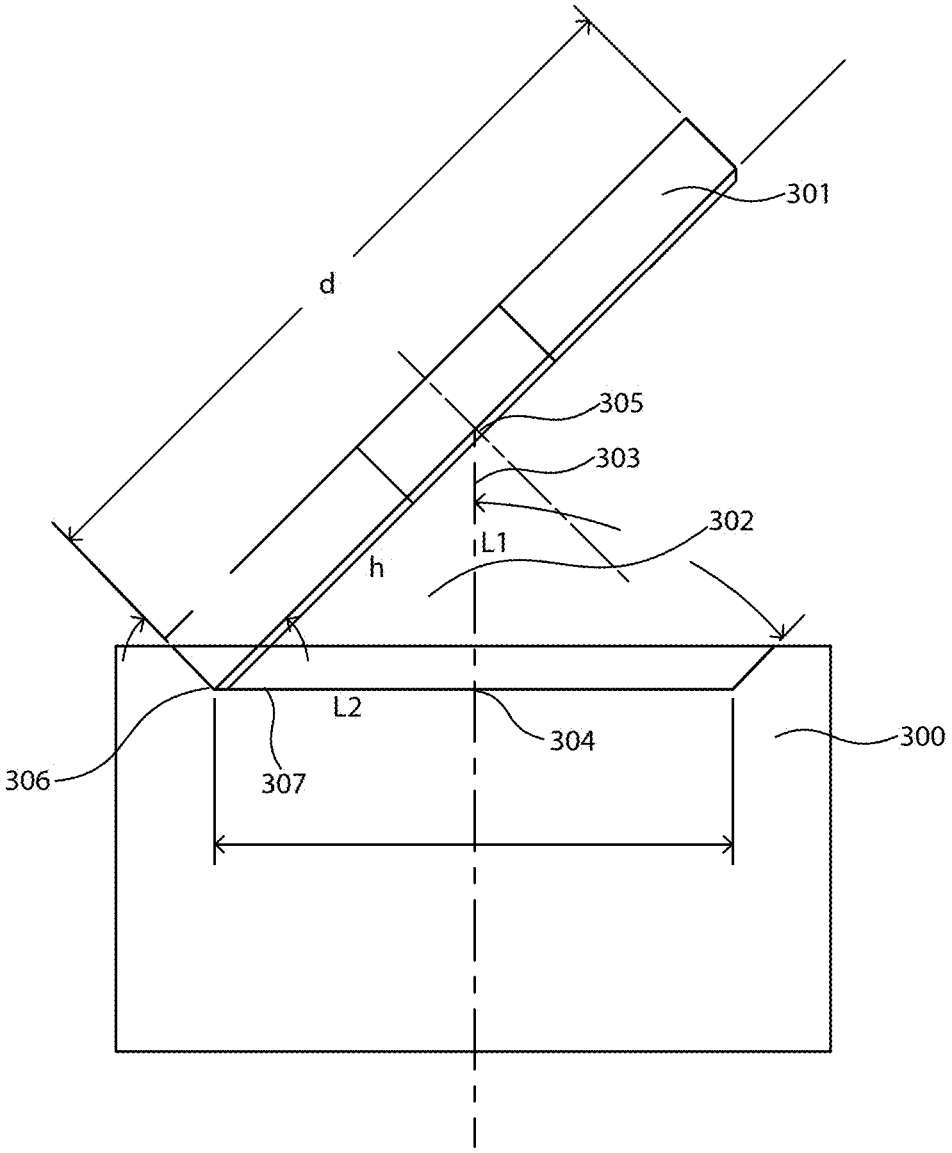
FIG. 3 includes a schematic representation of the orientation of a grinding wheel to a workpiece.

According to still further embodiments, the grinding tool may have a particular diameter based the shape and size of a desired feature that the grinding tool is intended to form on the surface of the workpiece. As illustrated in FIG. 3, according to a specific embodiment, the diameter (d) of the grinding tool 301 may not be greater than about twice the length of a hypotenuse (h) of a right triangle 302 having a first side length (L1) equal to the distance along the axis of rotation 303 for the workpiece 300 between a center-point 304 of the workpiece and a center-point 305 of the grinding tool and a second side length (L2) equal to a distance between the center-point 304 of the workpiece and a point 306 of the outer perimeter of an internal surface 307 of the workpiece 300 having the smallest diameter and being normal to the base surface 308 of the workpiece 300.

According to still further embodiments, the grinding process may include removing material from the workpiece by moving multiple grinding tools relative to the workpiece. For example, the grinding method may include moving at least two grinding tools relative to the workpiece, such as, moving at least three grinding tools relative to the workpiece, moving at least four grinding tools relative to the workpiece, moving at least five grinding tools relative to the workpiece or even moving at least six tools relative to the workpiece. It will be appreciated that, according to certain embodiments, the multiple grinding tools may each include a grinding surface defining the outer perimeter of each tool. In certain embodiments, the grinding surface of each grinding tool may have a contour configured to form at least a complex feature of the complex shape of the workpiece. According to certain embodiments, the complex features of the complex shape of the workpiece may be connected in sequence to form the complex shape of the workpiece (i.e., contiguous). According to still other embodiments, the complex features of the complex shape of the workpiece may not be connected in sequence (i.e., non-contiguous).

It will be further appreciated that the grinding process may include removing material from the workpiece by moving the multiple grinding tools relative to the workpiece in sequence, at different locations on the workpiece and oriented at different angles relative to the lateral reference plane of the workpiece such that each grinding tool forms a distinct complex feature of the complex shape and the combination of the distinct complex features after grinding by the multiple grinding wheels produces the complex shape on the surface of the workpiece. It will be further appreciated that distinct features of the surface may be formed in any order.

Figure 4A:
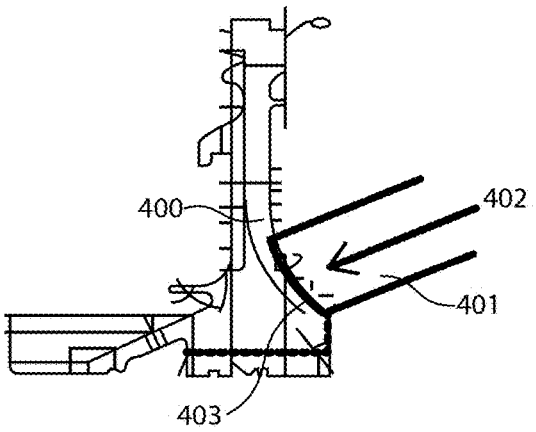
FIGS. 4A-4I includes schematic representations of a grinding method in accordance with an embodiment.
Figure 4B:
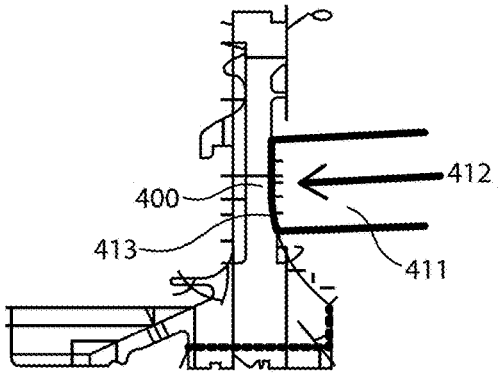
Figure 4C:
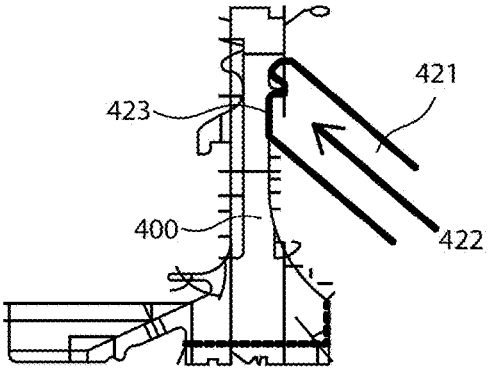
Figure 4D:
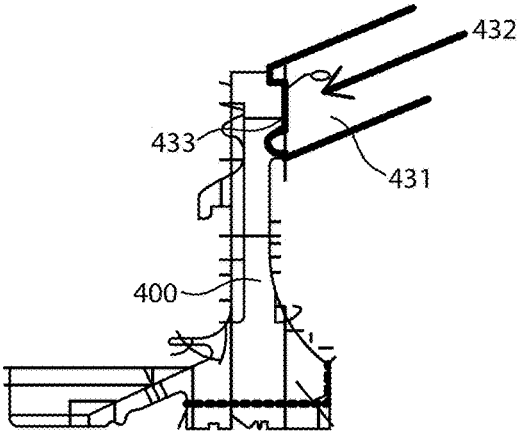
Figure 4E:
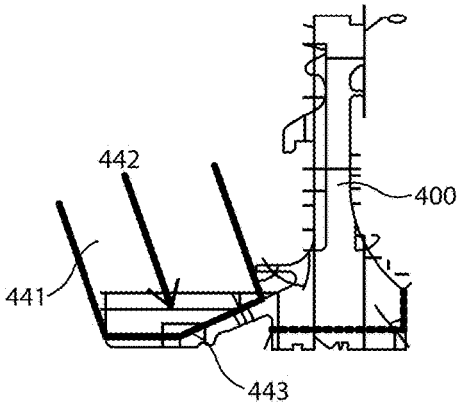
Figure 4F:
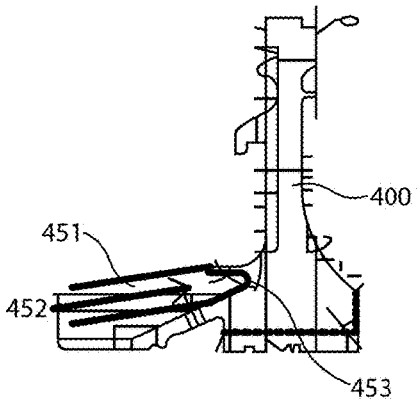
Figure 4G:
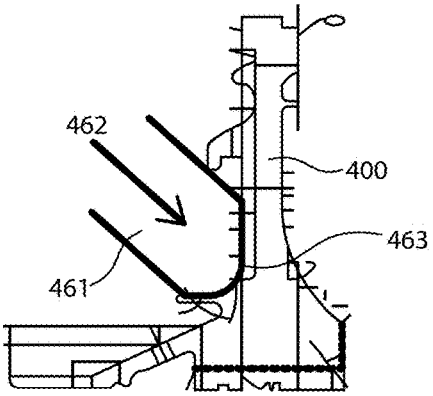
Figure 4H:
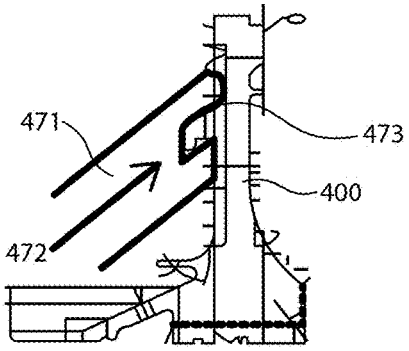
Figure 4I:
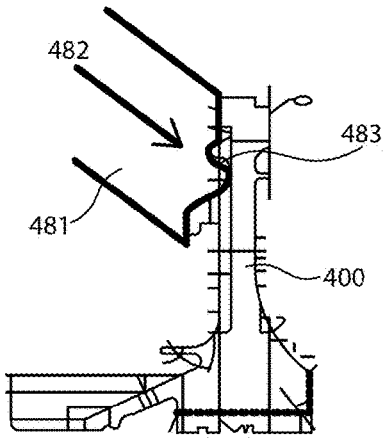

According to one particular embodiment, as shown in FIGS. 4A-I, a grinding process according to embodiments described herein may include removing material from a workpiece with nine grinding wheels that may include distinct grinding surfaces defining the outer perimeter of each tool. Each grinding wheel may be moved relative to the surface of the workpiece sequentially to form the respective complex surface feature, which, after completion of the grinding process, combine to form the complex surface of the workpiece. FIG. 4A illustrates the first grinding wheel 401, having a grinding surface 402 for grinding a first complex surface feature 403 on a workpiece 400. FIG. 4B illustrates the second grinding wheel 410, having a grinding surface 412 for grinding a second complex surface feature 413 on a workpiece 400. FIG. 4C illustrates the third grinding wheel 421, having a grinding surface 422 for grinding a third complex surface feature 423 on a workpiece 400. FIG. 4D illustrates the fourth grinding wheel 431, having a grinding surface 432 for grinding a fourth complex surface feature 433 on a workpiece 400. FIG. 4E illustrates the fifth grinding wheel 441, having a grinding surface 442 for grinding a fifth complex surface feature 443 on a workpiece 400. FIG. 4F illustrates the sixth grinding wheel 451, having a grinding surface 452 for grinding a sixth complex surface feature 453 on a workpiece 400. FIG. 4G illustrates the seventh grinding wheel 461, having a grinding surface 462 for grinding a seventh complex surface feature 463 on a workpiece 400. FIG. 4H illustrates the eighth grinding wheel 471, having a grinding surface 472 for grinding a eighth complex surface feature 473 on a workpiece 400. FIG. 4I illustrates the ninth grinding wheel 481, having a grinding surface 482 for grinding a ninth complex surface feature 483 on a workpiece 400. It will be appreciated that this example embodiment is not intended to be limiting and that any grinding tool described herein may be used in any sequence to grind a complex shape according to embodiments described herein.

It will also be appreciated that according to certain embodiments, the grinding process may be distinct from other material removal operations in that the ground surface of the workpiece upon completion of the grinding process can have particular characteristics. For example, upon completion of the grinding process, the ground surface can have a surface roughness ($R_a$) of not greater than about 2 microns. In other instances, the surface roughness ($R_a$) may be less, such as not greater than about 1.8 microns, not greater than about 1.6 microns, not greater than about 1.4 microns, not greater than about 1.2 microns, not greater than about 1 micron or even not greater than about 0.5 microns. According to still other embodiments, the surface roughness ($R_a$) of ground surface of the workpiece upon completion of the grinding process can be at least about 0.1 microns, at least about 0.5 microns, at least about 1.0 microns or even at least about 1.5 microns. It will be appreciated that the surface roughness ($R_a$) of ground surface of the workpiece upon completion of the grinding process may be any value within a range between any of the minimum and maximum values noted above. The surface roughness of the ground surface can be measured using a Profilometer, such as a MarSurf UD 120/LD 120 model Profilometer, commonly available from Mahr-Federal Corporation, and operated using MarSurf XCR software.

According to still other embodiments, upon completion of the grinding process, the ground surface may have a particular surface finish. For example, upon completion of the grinding process, the ground surface can have a surface finish of not greater than about 0.5 inches part distortion, such as, not greater than about 0.01 inches part distortion, not greater than about 0.05 inches part distortion or even not greater than about 0.001 inches part distortion. According to still other embodiments, upon completion of the grinding process, the ground surface can have a surface finish of at least about 0.0001 inches part distortion, such as, at least about 0.0005 inches part distortion, at least about 0.001 inches part distortion, at least about 0.05 inches part distortion, at least about 0.01 inches part distortion or even at least about 0.5 inches part distortion. It will be appreciated that removing material from the workpiece may result in a surface finish of any value within a range between any of the minimum and maximum values noted above.

According to still other embodiments, upon completion of the grinding process, the ground surface may have a particular surface roughness. For example, upon completion of the grinding process, the ground surface may have a surface roughness of at least about 0.5 μin, at least about 1 μin, at least about 5 μin, at least about 10 μin, at least about 15 μin, at least about 20 μin, at least about 25 μin or even at least about 30 μin. According to still other embodiments, upon completion of the grinding process, the grinding surface may have a surface roughness of not greater than about 35 μin, such as, not greater than about 20 μin or even not greater than about 10 μin. It will be appreciated that removing material may include finishing a workpiece to have a surface roughness of any value within a range between any of the minimum and maximum values noted above.

According to still other embodiments, upon completion of the grinding process, the ground surface may have a particular flatness. For example, upon completion of the grinding process, the ground surface may have a flatness of at least about 0.0001 inches, such as, at least about 0.00015 inches, at least about 0.0002 inches, at least about 0.00025 inches, at least about 0.0003 inches, at least about 0.00035 inches, at least about 0.0004 inches or even at least about 0.00045 inches. According to still other embodiments, upon completion of the grinding process, the ground surface may have a flatness of not greater than about 0.0005 inches, such as, not greater than about 0.00045 inches, not greater than about 0.0004 inches, not greater than about 0.0003 inches, not greater than about 0.0003 inches, not greater than about 0.00025 inches, not greater than about 0.0002 inches or even not greater than about 0.00015 inches. It will be appreciated that ground surface may have a flatness of any value within a range between any of the minimum and maximum values noted above.

According to still other embodiments, upon completion of the grinding process, the ground surface defining the complex shape may be essentially free of burn. Burn may be evidence as portions of the ground surface having discoloration or having a residue or after etching having a whitish appearance indicating thermal damage to the surfaces during the finishing operation. The processes conducted according to the embodiments herein are capable of producing final surfaces exhibiting little to no burn.

The material removal operations conducted in accordance with embodiments herein may utilize a coolant provided at the interface of the grinding tool 101 and the surface of the workpiece 100. The coolant may be provided in a coherent jet as described in U.S. Pat. No. 6,669,118. In other embodiments, the coolant may be provided by flooding the interface area. The bonded abrasive bodies of the embodiments herein may facilitate use of a water-soluble coolant, which may be preferable for environmental reasons over certain other coolants (e.g. non water-soluble coolants). Other suitable coolants can include use of semi-synthetic and/or synthetic coolants. Still, it will be appreciated, that for certain operations, oil-based coolants can be used.

In addition to the characteristics described herein, the bonded abrasive tools can be dressed in-situ with the finishing process. Dressing is understood in the art as a method of sharpening and reshaping of a bonded abrasive body, and is typically an operation conducted on bonded abrasive articles and not an operation suitable for use with other abrasive articles, including for example, single-layered abrasive tools (e.g. electroplated abrasive bodies).

Many different aspects and embodiments are possible. Some of these aspects and embodiments are described below. After reading this specification, those skilled in the art will appreciate that these aspects and embodiments are only illustrative and do not limit the scope of the present invention. Embodiments may be in accordance with any one or more of the items as listed below.

Item 1. A method of forming a workpiece comprising:
removing material from a workpiece having a machinability rating of not greater than a machinability rating of Inconel 718 by moving at least one grinding tool relative to the workpiece, wherein during moving the at least one grinding tool is oriented at an angle ($\alpha$) relative to a reference plane of the workpiece, and wherein removing material is conducted at a specific grinding energy of not greater than about 7 Hp/in$^3$ min (about 19 J/mm$^3$) for a material removal rate of at least about 2.5 in$^3$/min·in (about 25 mm$^3$sec/mm).

Item 2. A method of forming a workpiece comprising:
removing material from a workpiece having a machinability rating of not greater than a machinability rating of Inconel 718 at a specific grinding energy of not greater than about 7 Hp/in$^3$ min (about 19 J/mm$^3$) for a material removal rate of at least about 2.5 in$^3$/min·in (about 25 mm$^3$sec/mm), wherein removing material comprises:
moving a first grinding tool having a first peripheral contour relative to the workpiece; and
moving a second grinding tool having a second peripheral contour different than the first peripheral contour relative to the workpiece.

Item 3. A method of grinding a workpiece having a machinability rating of not greater than a machinability rating of Inconel 718 and at least one complex surface feature, the method defining a grinding process capable of removing at least about 3.5 in$^3$ of material per min (in$^3$/min).

Item 4. A method of forming a workpiece comprising:
removing material from a workpiece having a machinability rating of not greater than a machinability rating of Inconel 718 and at least one complex surface feature, wherein removing material comprises moving at least one grinding tool relative to the workpiece and,
wherein the grinding tool comprises:
an abrasive wheel comprising a grinding surface defining an outer perimeter of the grinding wheel, wherein a contour of the grinding surface is configured to form at least a portion of the complex surface feature of the workpiece.

Item 5. A method of forming a surface on a workpiece comprising:
removing material from a rotating workpiece having a machinability rating of not greater than a machinability rating of Inconel 718, wherein removing material comprises moving at least one grinding tool relative to the rotating workpiece and wherein a diameter of the grinding tool is not greater than about twice the length of a hypotenuse of a right triangle having a first side length equal to the distance along the axis of rotation for the workpiece between a center-point of the workpiece and a center-point of the grinding tool and a second side length equal to a distance between the center-point of the workpiece and a point on the outer perimeter of an internal surface of the workpiece having the smallest diameter and being normal to the surface of the workpiece.

Item 6. A method of forming a workpiece comprising:
removing material from a workpiece having a machinability rating of not greater than a machinability rating of Inconel 718 by moving a grinding tool relative to the workpiece, wherein during moving the grinding tool is oriented at an angle ($\alpha$) relative to a reference plane of the workpiece, and wherein during removing material, not greater than about 5% of the surface of the workpiece experiences burn.

Item 7. The method of forming a workpiece of any one of items 1, 2, 3, 4, 5 and 6, wherein the workpiece comprises a machinability rating of not greater than about 90% of the machinability rating of Inconel 718, not greater than about 80%, not greater than about 70%, not greater than about 60%, not greater than about 50%, not greater than about 40%, not greater than about 30%, not greater than about 20%, not greater than about 10% and not greater than about 5% of the machinability rating of Inconel 718.

Item 8. The method of forming a workpiece of any one of items 1, 2, 3, 4, 5 and 6, wherein the workpiece comprises a machinability rating of at least about 2% of the machinability rating of Inconel 718, at least about 5%, at least about 10%, at least about 15%, at least about 20%, at least about 30%, at least about 40%, at least about 50%, at least about 60%, at least about 70%, at least about 80% and at least about 90% of the machinability rating of Inconel 718.

Item 9. The method of forming a workpiece of any one of items 1, 2, 3, 4, 5 and 6, wherein removing material from the workpiece results in a surface finish of the workpiece of not greater than about 0.5 inches part distortion, not greater than about 0.01 inches part distortion, 0.05 inches part distortion and 0.001 inches part distortion.

Item 10. The method of forming a workpiece of any one of items 1, 2, 3, 4, 5 and 6, wherein removing material comprises removing a depth of material from the surface of the workpiece of at least about 0.005 inches, at least about 0.006 inches, at least about 0.007 inches, at least about 0.008 inches, at least about 0.009 inches, at least about 0.01 inches, at least about 0.015 inches and at least about 0.02 inches.

Item 11. The method of forming a workpiece of any one of items 1, 3, 4, 5 and 6, wherein removing material from the workpiece comprises moving at least two grinding tools relative to the workpiece, at least three grinding tools, at least four grinding tools and at least five finding tools.

Item 12. The method of forming a workpiece of item 11, wherein each of the grinding tools comprise a grinding surface defining an outer perimeter of the grinding tools.

Item 13. The method of forming a workpiece of item 12, wherein the grinding surface of each grinding tool comprises a peripheral contour configured to form at least a portion of a complex shape on a surface of the workpiece.

Item 14. The method of forming a workpiece of any one of items 1, 2, 3, 4, 5 and 6, wherein removing material is conducted at a specific grinding energy of not greater than about 7 Hp/in$^3$ min (about 19 J/mm$^3$) for a material removal rate of at least about 2.5 in$^3$/min·in (about 25 mm$^3$sec/mm), not greater than about 6.5 Hp/in$^3$ min, not greater than about 6.0 Hp/in$^3$ min, not greater than about 5.5 Hp/in$^3$ min, not greater than about 5.0 Hp/in$^3$ min, not greater than about 4.5 Hp/in$^3$ min, not greater than about 4.0 Hp/in$^3$ min, not greater than about 3.5, Hp/in$^3$ min, not greater than about 3.0 Hp/in$^3$ min and not greater than about 2.5 Hp/in$^3$ min for a material removal rate of at least about 2.5 in$^3$/min·in (about 25 mm$^3$sec/mm).

Item 15. The method of forming a workpiece of any one of items 1, 2, 3, 4, 5 and 6, wherein the at least one grinding tool is oriented at an angle (α) relative to a reference plane of the workpiece and wherein the angle is an acute angle, wherein the angle is at least about 5° , at least about 10° , at least about 15° , at least about 20° , at least about 25° , at least about 30° , at least about 35° , at least about 40° , at least about 45° , at least about 50° , at least about 55° , at least about 60° , at least about 65° , at least about 70° , at least about 75° , at least about 80° , at least about 85° and wherein the tool is perpendicular to the reference plane of the workpiece.

Item 16. The method of forming a workpiece of any one of items 1, 2, 3, 4, 5 and 6, wherein the at least one grinding tool is oriented at an angle (α) relative to a reference plane of the workpiece and wherein the angle is not greater than about 90° , not greater than about 85° , not greater than about 80° , not greater than about 75° , not greater than about 70° , not greater than about 65° , not greater than about 60° , not greater than about 55° , not greater than about 50° , not greater than about 45° , not greater than about 40° , not greater than about 35° , not greater than about 30° , not greater than about 25° , not greater than about 20° , not greater than about 15° and not greater than about 10° .

Item 17. The method of forming a workpiece of any one of items 1, 2, 3, 4, 5 and 6, wherein removing material comprises grinding the workpiece to have a roughness of at least about 1 Ra, at least about 2 Ra, at least about 3 Ra, at least about 4, Ra, at least about 5 Ra, at least about 6 Ra, at least about 7 Ra, at least about 8 Ra, at least about 9 Ra and at least about 10 Ra.

Item 18. The method of forming a workpiece of any one of items 1, 2, 3, 4, 5 and 6, wherein removing material comprises grinding the workpiece to have a roughness of not greater than about 20 Ra, not greater than about 15 Ra, not greater than about 10 Ra, not greater than about 9 Ra, not greater than about 8 Ra, not greater than about 7 Ra, not greater than about 6 Ra and not greater than about 5 Ra.

Item 19. The method of forming a workpiece of any one of items 1, 2, 3, 4, 5 and 6, wherein removing material comprises grinding the workpiece to have a surface roughness of not greater than about 30 μin, not greater than about 25 μin, not greater than about 20 μin, not greater than about 15 μin, not greater than about 10 μin, not greater than about 5 μin and not greater than about 1 μin.

Item 20. The method of forming a workpiece of any one of items 1, 2, 3, 4, 5 and 6, wherein removing material comprises grinding the workpiece to have a surface roughness of at least about 0.5 μin, at least about 1 μin, at least about 5 μin, at least about 10 μin, at least about 15 μin, at least about 20 μin, at least about 20 μin and at least about 25 μin.

Item 21. The method of forming a workpiece of any one of items 1, 2, 3, 4, 5 and 6, wherein removing material comprises grinding the workpiece to have a flatness of at least about 0.0001", at least about 0.00015", at least about 0.0002", at least about 0.00025", at least about 0.0003", at least about 0.00035", at least about 0.0004" and at least about 0.00045".

Item 22. The method of forming a workpiece of any one of items 1, 2, 3, 4, 5 and 6, wherein removing material comprises grinding the workpiece to have a flatness of not greater than about 0.0005", not greater than about 0.00045", not greater than about 0.0004", not greater than about 0.00035", not greater than about 0.0003", not greater than about 0.00025", not greater than about 0.0002" and not greater than about 0.00015".

Item 23. The method of forming a workpiece of any one of items 1, 2, 3, 4, 5 and 6, wherein the workpiece comprises a cast metal.

Item 24. The method of forming a workpiece of any one of items 1, 2, 3, 4, 5 and 6, wherein the workpiece comprises a powdered metal.

Item 25. The method of forming a workpiece of any one of items 23 or 24, wherein the workpiece comprises a nickel alloy.

Item 26. The method of forming a workpiece of item 25, wherein the workpiece comprises at least about 50 wt. % nickel alloy for a total weight of the workpiece, at least about 60 wt. %, at least about 70 wt. %, at least about 80 wt. %, at least about 90 wt. % and at least about 95 wt. %.

Item 27. The method of forming a workpiece of item 25, wherein the workpiece comprises not greater than about 100 wt. % nickel alloy for a total weight of the workpiece, not greater than about 95 wt. %, not greater than about 90 wt. %, not greater than about 80 wt. %, not greater than about 70 wt. % and not greater than about 60 wt. %.

Item 28. The method of forming a workpiece of any one of items 1, 2, 3, 4, and 6, wherein a diameter of the grinding tool is not greater than about twice the length of a hypotenuse of a right triangle formed by a line between a center-point of the workpiece and a center-point of the grinding tool along an axis of rotation of the rotating workpiece and a line between the center-point of the rotating workpiece and a point of the outer perimeter of an internal surface of the workpiece having the smallest diameter and being normal to the surface of the workpiece.

Item 29. The method of forming a workpiece of any one of items 1, 2, 3, 4, 5 and 6, wherein during removing material, not greater than about 5% of the surface of the workpiece experiences burn, not greater than about 4.5%, not greater than about 4.0%, not greater than about 3.5%, not greater than about 3.0%, not greater than about 2.5%, not greater than about 2.0%, not greater than about 1.5%, not greater than about 1.0%, not greater than about 0.5%, substantially no portion of the surface of the workpiece experiences burn.

Item 30. The method of forming a workpiece of any one of items 1, 2, 3, 4, 5 and 6, wherein the at least one grinding tool comprises a bonded abrasive body having abrasive grains contained within a bond material.

Item 31. The method of forming a workpiece of item 30, wherein the bonding material comprises a material selected from the group of materials consisting of organic, inorganic, and a combination thereof.

Item 32. The method of forming a workpiece of item 31, wherein the bonding material comprises an organic material selected from the group consisting of resins, epoxies, and a combination thereof.

Item 33. The method of forming a workpiece of item 31, wherein the bonding material comprises an inorganic material selected from the group consisting of metals, metal alloys, ceramics, and a combination thereof.

Item 34. The method of forming a workpiece of item 33, wherein the bonding material comprises a ceramic material comprising a vitreous material.

Item 35. The method of forming a workpiece of item 34, wherein the vitreous material comprises an oxide.

Item 36. The method of forming a workpiece of item 30, wherein the abrasive grains comprise a superabrasive material.

Item 37. The method of forming a workpiece of item 36, wherein the abrasive grains consist essentially of diamond.

Item 38. The method of forming a workpiece of item 36, wherein the abrasive grains consist essentially of cubic boron nitride (cBN).

Item 39. The method of forming a workpiece of item 30, wherein the abrasive grains have an average grit size of at least about 10 microns, at least about 20 microns, at least about 30 microns, at least about 50 microns, at least about 75 microns, at least about 100 microns and at least about 125 microns.

Item 40. The method of forming a workpiece of item 30, wherein the abrasive grains have an average grit size of not greater than about 150 microns, not greater than about 125 microns, not greater than about 100 microns.

Item 41. The method of forming a workpiece of item 30, wherein the abrasive grains comprise at least about 2 vol % for a total bonded abrasive body, at least about 10 vol %, at least about 20 vol %, at least about 25 vol %, at least about 30 vol %, at least about 35 vol %, at least about 40 vol %, at least about 45 vol % and at least about 50 vol %.

Item 42. The method of forming a workpiece of item 30, wherein the abrasive grains comprise not greater than about 60 vol % for a total bonded abrasive body, not greater than about 50 vol %, not greater than about 40 vol %, not greater than about 30 vol %, not greater than about 20 vol % and not greater than about 10 vol %.

Item 43. The method of forming a workpiece of item 30, wherein the abrasive grains comprise not greater than about 60 vol % for a total bonded abrasive body, not greater than about 50 vol %, not greater than about 40 vol %, not greater than about 30 vol %, not greater than about 20 vol % and not greater than about 10 vol %.

Item 44. The method of forming a workpiece of item 30, wherein the bonding material comprises between about 2 vol % for a total volume of the bonded abrasive body, at least about 4 vol %, at least about 6 vol %, at least about 8 vol %, at least about 10 vol %, and at least about 15 vol %.

Item 45. The method of forming a workpiece of item 30, wherein the bonding material comprises not greater than about 60 vol % for a total bonded abrasive body, not greater than about 50 vol %, not greater than about 40 vol %, not greater than about 30 vol % and not greater than about 20 vol %.

Item 46. The method of forming a workpiece of item 30, wherein the body comprises a porosity of at least about 0.5 vol % for a total volume of the bonded abrasive body, at least about 1 vol %, at least about 1.5 vol %, at least about 2 vol %, at least about 5 vol %, at least about 10 vol %, at least about 15 vol %, at least about 20 vol %, at least about 25 vol %, at least about 30 vol %, at least about 35 vol %, at least about 40 vol % and at least about 45 vol %.

Item 47. The method of forming a workpiece of item 30, wherein the body comprises a porosity of not greater than about 60 vol % for a total volume of the bonded abrasive body, not greater than about 50 vol %, not greater than about 40 vol %, not greater than about 30 vol %, not greater than about 20 vol %, not greater than about 10 vol %, not greater than about 5 vol % and not greater than about 1 vol %.

Item 48. The method of forming a workpiece of item 30, wherein the porosity of the body comprises at least about 10 vol % interconnected porosity for a total volume of porosity of the bonded abrasive body, at least about 20 vol %, at least about 30 vol %, at least about 40 vol %, at least about 50 vol %, at least about 60 vol %, at least about 70 vol %, at least about 80 vol %, at least about 90 vol %, at least about 99 vol %, substantially all of the porosity of the body comprises interconnected porosity.

Item 49. The method of forming a workpiece of item 30, wherein the porosity of the body comprises not greater than about 90 vol % interconnected porosity, not greater than about 80 vol %, not greater than about 70 vol %, not greater than about 60 vol %, not greater than about 50 vol %, not greater than about 40 vol %, not greater than about 30 vol %, not greater than about 20 vol % and not greater than about 10 vol %.

Item 50. The method of forming a workpiece of any one of items 1, 2, 3, 4, 5 and 6, wherein the method further finishing at least a portion of the surface of the workpiece.

Item 51. The method of forming a workpiece of item 50, wherein finishing at least a portion of the surface comprises at least one additional grinding step.

Item 52. The method of forming a workpiece of item 50, wherein finishing at least a portion of the surface comprises at least one polishing step.

Item 53. The method of forming a workpiece of any of items 50, 51 and 52, wherein not greater than about 50% of the surface of the workpiece must be finished following the step of removing material from the workpiece, not greater than about 40%, not greater than about 30%, not greater than about 20%, not greater than about 10%, not greater than about 5%, not greater than about 1%.

EXAMPLE 1

Figure 5:
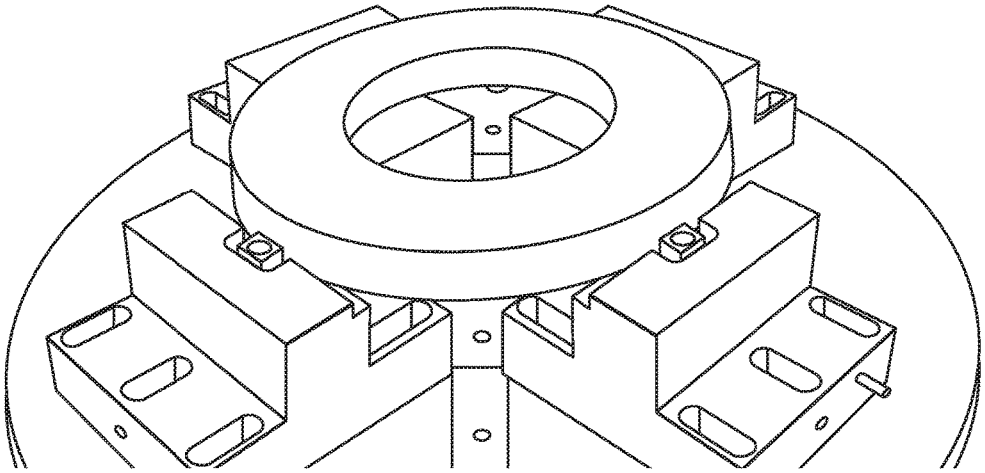
FIG. 5 includes an image of a blank workpiece.

A workpiece having a complex surface was formed according to embodiments described herein using three TG280-F20VTX2 grinding wheels (available commercially from Saint-Gobain). The workpiece, shown in FIG. 5, was made of Inconel 718.

Figure 6:
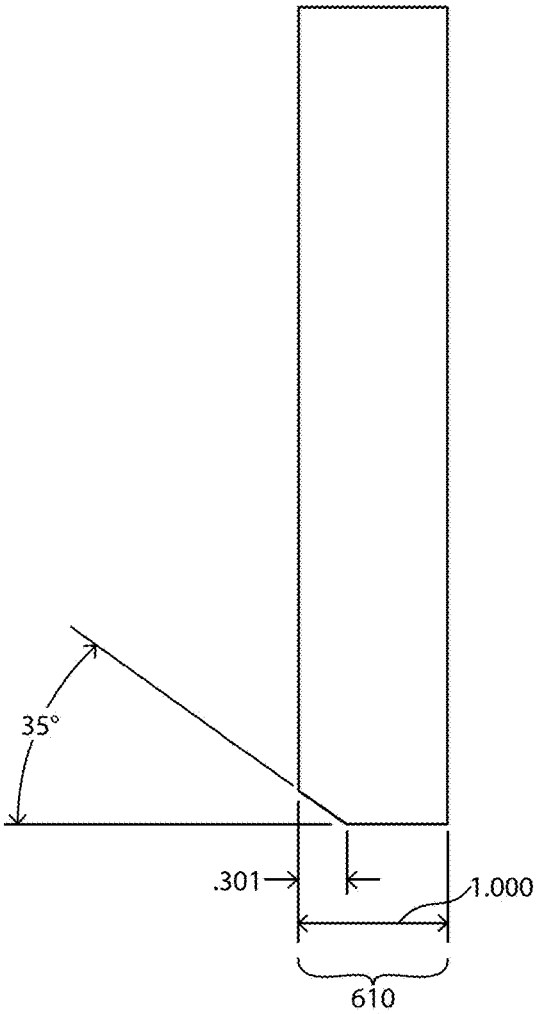
FIG. 6 includes a cross-sectional illustration of a grinding tool according to an embodiment.
Figure 7:
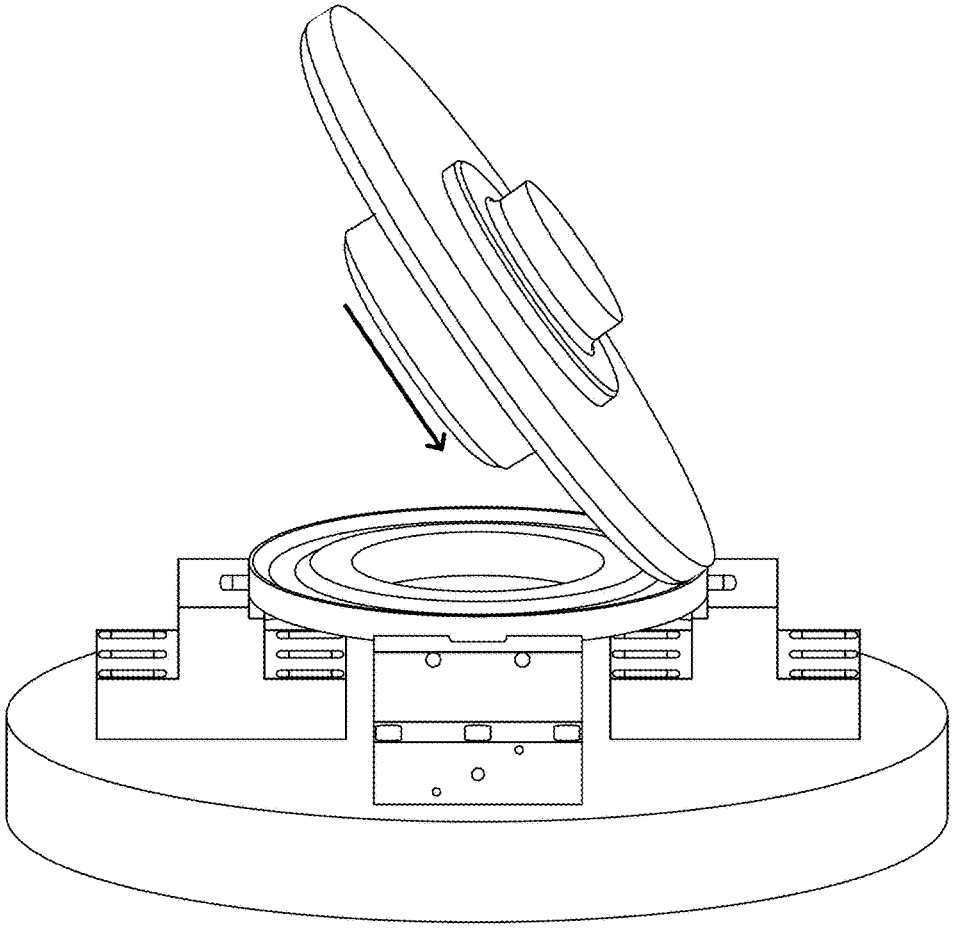
FIG. 7 includes a schematic representation of a portion of a grinding method in accordance with an embodiment.

The first grinding wheel had a peripheral grinding surface defining the perimeter of the wheel. FIG. 6 illustrates the contour 610 of the peripheral grinding surface of the first grinding wheel. During grinding, the first grinding wheel was oriented at an angle of 55 degrees relative to a lateral reference plane of the workpiece and was directed toward the outer perimeter of a first side of the workpiece, as illustrated in FIG. 7, to form a first complex feature in the workpiece. The first grinding wheel operated at a work speed of 159 ipm and a wheel speed of 6500 sfpm with a feed rate of 0.025 ipr. The depth of material removed during the grinding process with the first wheel was 0.25" from the surface of the workpiece. An oil coolant was applied during grinding. The first wheel operated at a specific grinding energy of 3.7 $HP/in^3/min$.

Figure 8:
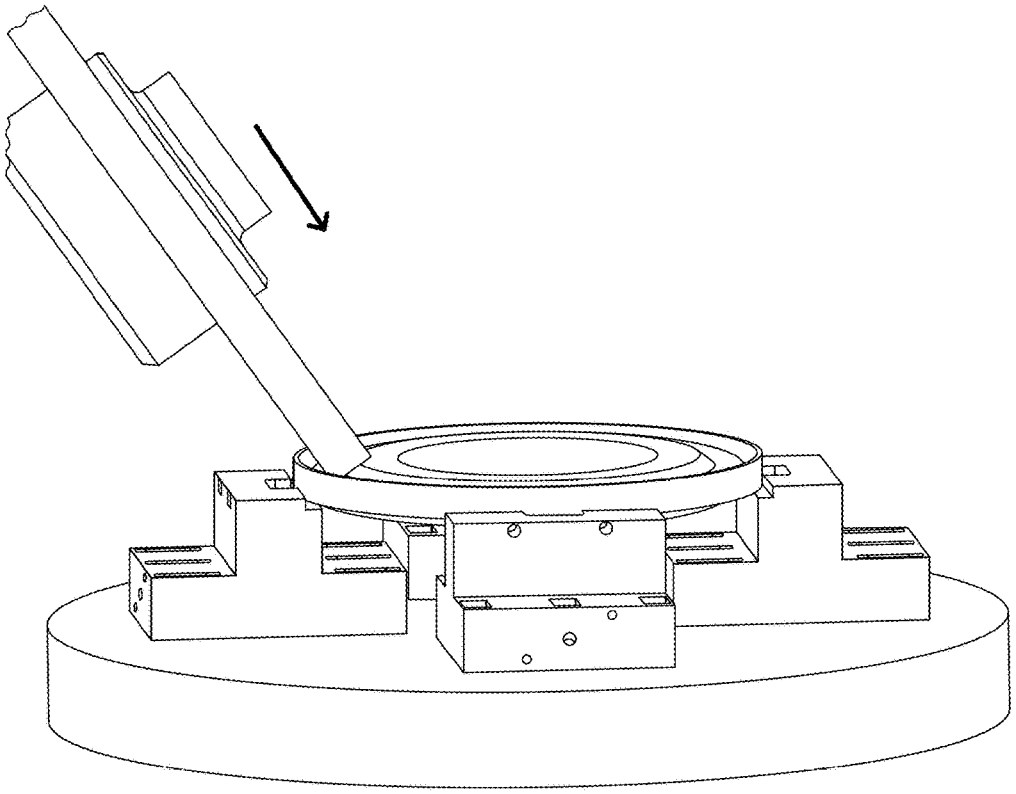
FIG. 8 includes a schematic representation of a portion of a grinding method in accordance with an embodiment.

The second grinding wheel had a peripheral grinding surface defining the perimeter of the wheel. The contour of the peripheral grinding surface of the second grinding wheel was the same as the contour of the peripheral grinding surface of the first grinding wheel. During grinding, the second grinding wheel was oriented at an angle of 55 degrees relative to a lateral reference plane of the workpiece and was directed toward an interior portion of the first side of the workpiece, as illustrated in FIG. 8, to form a second complex feature in the workpiece. The second grinding wheel operated at a work speed of 159 ipm and a wheel speed of 6500 sfpm with a feed rate of 0.025 ipr. The depth of material removed during the grinding process with the second grinding wheel was 0.25" from the surface of the workpiece. An oil coolant was applied during grinding. The second wheel operated at a specific grinding energy of 3.7 $HP/in^3/min$.

Figure 9:
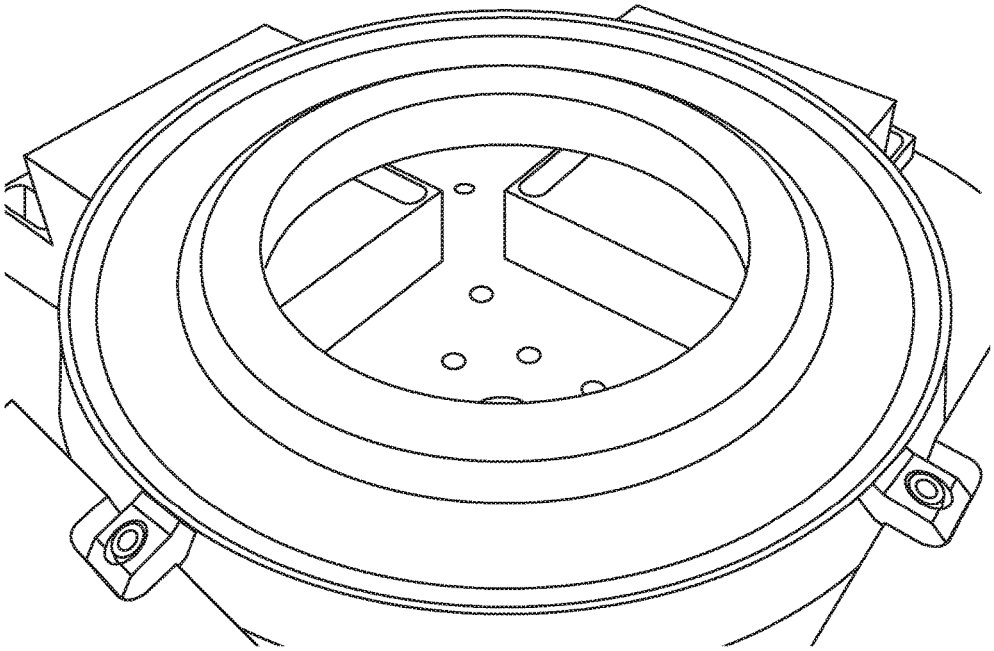
FIG. 9 includes an image of a first side of a ground workpiece.

FIG. 9 illustrates a first side of the workpiece after grinding by the first and second grinding wheels. The ground surface of the first side of the workpiece includes a complex shape following at least the first and second complex features formed by the first and second grinding wheels respectively.

Figure 10:
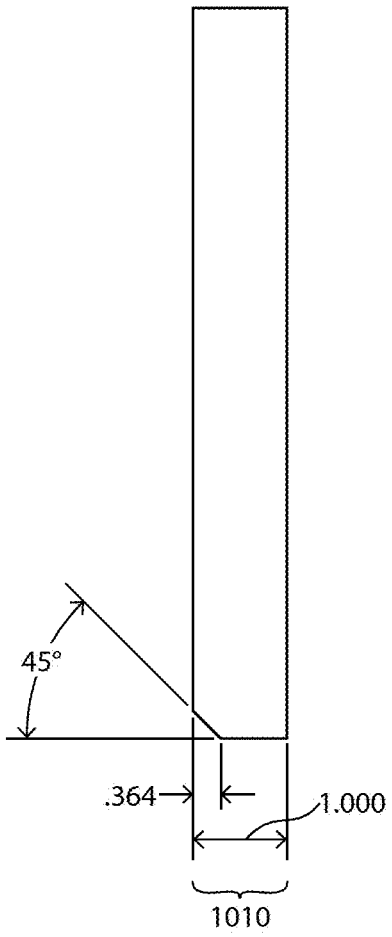
FIG. 10 includes a cross-sectional illustration of a grinding tool according to an embodiment.
Figure 11:
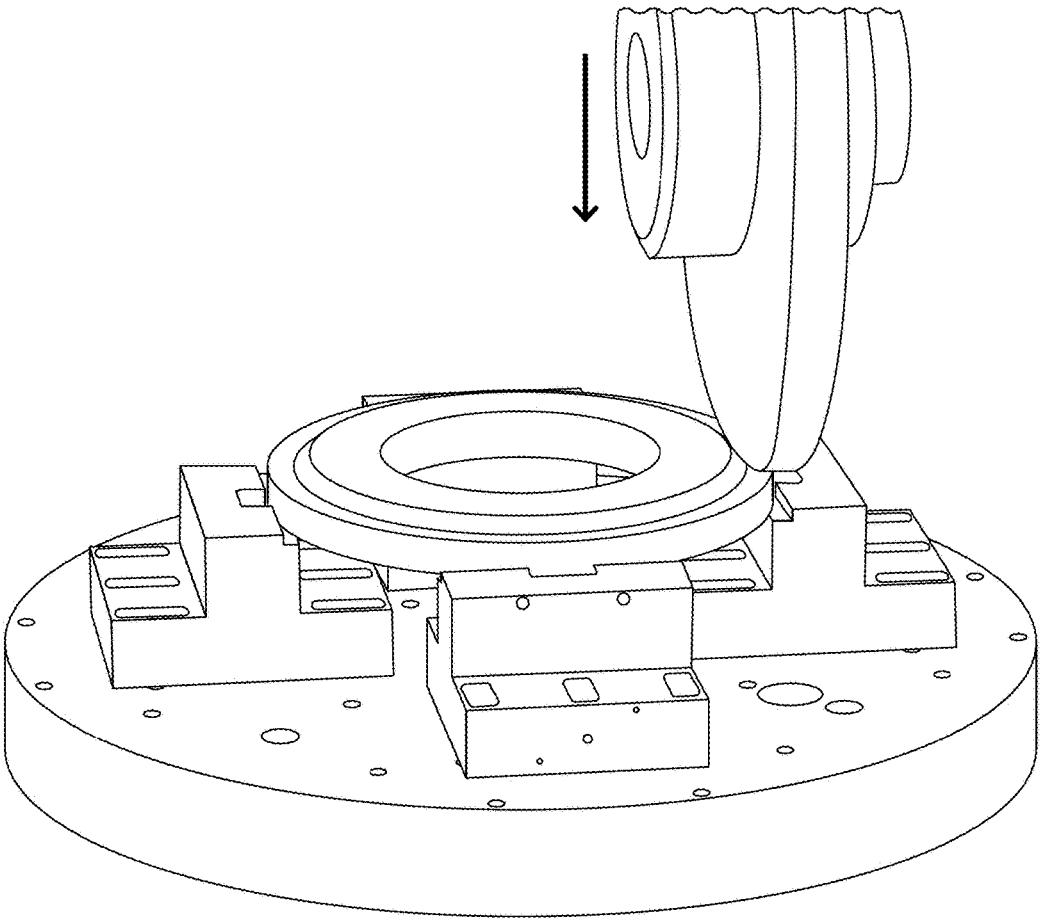
FIG. 11 includes a schematic representation of a portion of a grinding method in accordance with an embodiment.

The third grinding wheel had a peripheral grinding surface defining the perimeter of the wheel. FIG. 10 illustrates the contour 1010 of the peripheral grinding surface of the third grinding wheel. During grinding, the third grinding wheel was oriented at an angle of 90 degrees relative to (i.e., perpendicular to) a lateral reference plane of the workpiece and was directed toward the outer perimeter of a second side of the workpiece, as illustrated in FIG. 11, to form a third complex feature in the workpiece. The third grinding wheel operated at a work speed of 159 ipm and a wheel speed of 6500 sfpm with a feed rate of 0.025 ipr. The depth of material removed during the grinding process with the third wheel was 0.25" from the surface of the workpiece. An oil coolant was applied during grinding. The third wheel operated at a specific grinding energy of 2.0 $HP/in^3/min$.

Figure 12:
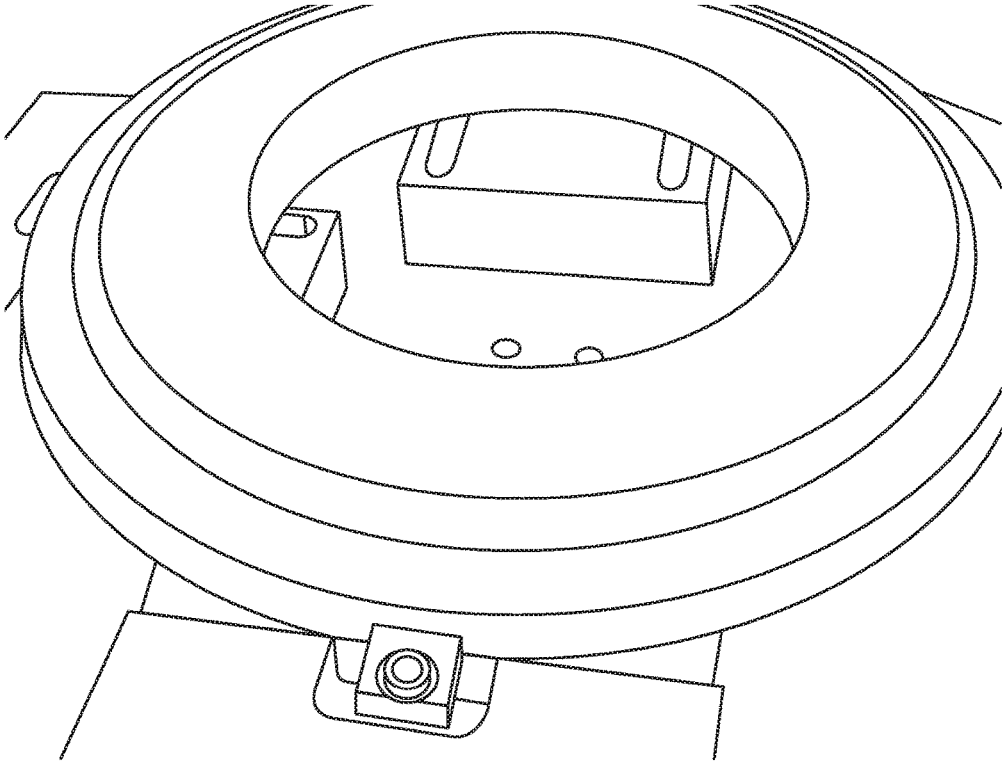
FIG. 12 includes an image of a second side of a ground workpiece.

FIG. 12 illustrates a second side of the workpiece after grinding by the third grinding wheels. The ground surface of the second side of the workpiece includes a complex shape following at least the third complex feature formed by the third grinding wheel.

Following the grinding process, the surface quality of the first, second and third complex features were measured and are shown in Table 1 below.

TABLE 1

| Surface Quality Parameters | Surface Feature 1 | Surface Feature 2 | Surface Feature 2 |
|---|---|---|---|
| Surface Roughness ($R_a$) | 33.5 | 34 | 39.5 |
| Surface Roughness ($R_z$) | 353 | 270.5 | 236.5 |
| Surface Roughness (Rt) | 366 | 386 | 294 |

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the scintillation and radiation detection arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A method of forming a workpiece comprising:

removing material while rotating a workpiece having a machinability rating of not greater than a machinability rating of Inconel 718 at a specific grinding energy of not greater than about 7 $Hp/in^3$ min (about 19 $J/mm^3$) for a material removal rate of at least about 2.5 $in^3/min \cdot in$, by moving multiple grinding wheels relative to the rotating workpiece in sequence at different locations on the rotating workpiece and oriented at different angles relative to a lateral reference plane of the rotating workpiece, wherein each of the multiple grinding wheels forms a distinct complex surface feature of a complex shape of the workpiece.

2. The method of forming a workpiece of claim 1, wherein each of the multiple grinding wheels comprises:

a first surface perpendicular to an axis of rotation of the grinding wheel;

a second surface opposite the first surface;

an outer perimeter extending between the first and second surfaces and defining a thickness of the grinding wheel; and a diameter that is greater than the thickness of the grinding wheel.

3. The method of forming a workpiece of claim 2, wherein the outer perimeter defines a grinding surface.

4. The method of forming a workpiece of claim 3, wherein the grinding surface comprises a peripheral contour configured to form one of the at least two complex features of the contiguous complex shape on a surface of the workpiece.

5. The method of forming a workpiece of claim 1, wherein removing material from the rotating workpiece comprises moving at least three grinding wheels.

6. The method of forming a workpiece of claim 1, wherein removing material is conducted at a specific grinding energy of not greater than about 6.0 $Hp/in^3$ min for a material removal rate of at least about 2.5 $in^3/min \cdot in$.

7. The method of forming a workpiece of claim 1, wherein at least one of the multiple grinding wheels is oriented at an angle ($\alpha$) relative to a reference plane of the rotating workpiece and wherein the angle ($\alpha$) is an acute angle.

8. The method of forming a workpiece of claim 1, wherein the multiple grinding wheels comprises a bonded abrasive body having abrasive grains contained within a bond material.

9. The method of forming a workpiece of claim 8, wherein the bond material comprises a ceramic material comprising a vitreous material.

10. The method of forming a workpiece of claim 9, wherein the vitreous material comprises an oxide.

11. The method of forming a workpiece of claim 9, wherein the abrasive grains comprise at least about 2 vol % for a total volume of the bonded abrasive body.

12. The method of forming a workpiece of claim 9, wherein the bonding material comprises at least about 2 vol % for a total volume of the bonded abrasive body.

13. The method of forming a workpiece of claim 9, wherein the body comprises a porosity of at least about 0.5 vol % for a total volume of the bonded abrasive body.

14. The method of forming a workpiece of claim 13, wherein the porosity of the body comprises at least about 10 vol % interconnected porosity for a total volume of the porosity of the bonded abrasive body.

15. A method of forming a workpiece comprising:

removing material while rotating a workpiece having a machinability rating of not greater than a machinability rating of Inconel 718 at a specific grinding energy of not greater than about 7 $Hp/in^3$ min (about 19 $J/mm^3$) for a material removal rate of at least about 2.5 $in^3/min \cdot in$, by moving at least two grinding wheels relative to the rotating workpiece in sequence at different locations on the rotating workpiece and oriented at different angles relative to a lateral reference plane of the rotating workpiece, wherein each of the at least two grinding wheels forms a distinct complex surface feature of a complex shape of the workpiece, and wherein the at least two grinding wheels comprises:

a first grinding wheel having a grinding surface for grinding a first complex feature on the workpiece;

a second grinding wheel having a grinding surface for grinding a second complex feature on the workpiece; and a third grinding wheel having a grinding surface for grinding a third complex feature on the workpiece.

* * * * *